US007484381B2

(12) United States Patent
Lattanzio

(10) Patent No.: US 7,484,381 B2
(45) Date of Patent: Feb. 3, 2009

(54) ENERGY RECOVERY UNIT

(75) Inventor: Maurice Lattanzio, Kettleby (CA)

(73) Assignee: Spinnaker Industries Inc., Etobicoke (CA)

( * ) Notice: Subject to any disclaimer, the term of this patent is extended or adjusted under 35 U.S.C. 154(b) by 361 days.

(21) Appl. No.: 10/887,096

(22) Filed: Jul. 9, 2004

(65) Prior Publication Data

US 2006/0005560 A1 Jan. 12, 2006

(51) Int. Cl.
*F25D 23/00* (2006.01)

(52) U.S. Cl. ..... 62/271; 62/32; 62/427; 62/279; 62/332; 62/176.6; 62/93; 62/176.1; 62/94; 165/4

(58) Field of Classification Search ..... 62/271, 62/90, 95, 314, 315, 312, 94, 332, 93, 176.1, 62/419, 176.6, 32, 427, 279; 165/7, 8, 10, 165/54, 210, 1, 165, 166, 4
See application file for complete search history.

(56) References Cited

U.S. PATENT DOCUMENTS 3,695,250 A * 10/1972 Rohrs et al. ..... 126/110 R
4,093,435 A * 6/1978 Marron et al. ..... 96/125
4,513,809 A * 4/1985 Schneider et al. ..... 165/54
4,611,653 A * 9/1986 Ikemura et al. ..... 165/54
4,727,931 A * 3/1988 Berner ..... 165/8
4,887,438 A * 12/1989 Meckler ..... 62/271
5,426,953 A * 6/1995 Meckler ..... 62/271
6,029,467 A * 2/2000 Moratalla ..... 62/271
6,141,979 A * 11/2000 Dunlap ..... 62/176.6
6,751,964 B2 * 6/2004 Fischer ..... 62/94
6,829,900 B2 * 12/2004 Urch ..... 62/3.2
6,959,875 B2 * 11/2005 Yabu et al. ..... 236/44 C

FOREIGN PATENT DOCUMENTS

CA 2473333 * 9/2006

* cited by examiner

*Primary Examiner*—Cheryl J. Tyler
*Assistant Examiner*—Emily Iris Nalven
(74) *Attorney, Agent, or Firm*—John R. S. Orange; Blake, Cassels & Graydon LLP.

(57) ABSTRACT

An energy recovery unit has an energy recovery wheel located in a plenum. Expelled air from the return duct is delivered to the plenum and after passing through the wheel is expelled by an exhaust fan through a side wall. Makeup air is delivered to the plenum and after passing through the wheel is supplied to the return duct by a fan. The makeup air follows a serpentine path from an intake in a side wall to the return duct.

10 Claims, 3 Drawing Sheets

ENERGY RECOVERY UNIT

FIELD OF THE INVENTION

The present invention relates to energy recovery units for use with air handling systems.

SUMMARY OF THE INVENTION

It is a common practice to heat and cool premises using air as the heat transfer medium. The air is ducted from an air handling unit that can either supply heat to or extract heat from the air to different outlets within the building. Air is returned from the building through a network of return ducts so that the air is continuously circulated within the building.

In order to maintain air quality at the requisite level, it is usual to reject a portion of the return air and replace it with air from outside the building. This maintains the air quality whilst avoiding continuous reheating of the air within the building. However, the air rejected from the building has been conditioned so it represents a significant energy loss if it is simply expelled. Similarly, the makeup air needs to be heated or cooled to the conditions within the building which requires further use of energy.

To minimize the energy consumption, it is known to recover energy from the expelled air and utilize it to precondition the makeup air. Such units may be as simple as counterflow heat exchangers so that the outgoing air flows in a parallel path to the incoming air and energy is exchanged between the two. Alternatively, more sophisticated arrangements may be utilized in which the expelled air is forced through a rotary energy recovery unit. The energy recovery unit has a large rotating disc that traverses a pair of ducts, one for expelled air and one for makeup air. The wheel absorbs heat and/or moisture from the expelled air and transfers it to the duct carrying the makeup air. The ducts are maintained separate from one another to minimize cross bleeding of the air whilst the heat transfer efficiency is enhanced due to the large cross-sectional area presented by the disc that the air must pass through.

Such arrangements have improved the energy consumption significantly but do not readily lend themselves to compact installations within existing systems. Typically, the wheels are oriented on a horizontal axis that increases the overall height of the unit and requires it to be placed in a separate stand alone unit. This not only increases the expense of such a unit but also effects the aesthetics of the building upon which it is installed. Moreover, the ducting of air within the energy recovery unit results in the inlet and outlets being spaced apart a significant distance that further increases the size of the unit and the overall installation.

It is therefore an object of the present invention to obviate or mitigate the above disadvantages.

In general terms, the present invention provides an energy recovery unit for an air handling system having a pair of ducts. The unit includes a pair of internal ducts, one for expelled air and the other for makeup air. Each of the ducts pass through a plenum. An energy recovery wheel is located within the plenum and subdivides it to maintain the ducts separate. The wheel is inclined to a horizontal plane and the make up air duct follows a serpentine path within the unit to discharge adjacent to the inlet to the expelled air duct.

DESCRIPTION OF THE PREFERRED EMBODIMENTS

An embodiment of the invention will now be described by way of example only with reference to the accompanying drawings in which.

Figure 1:
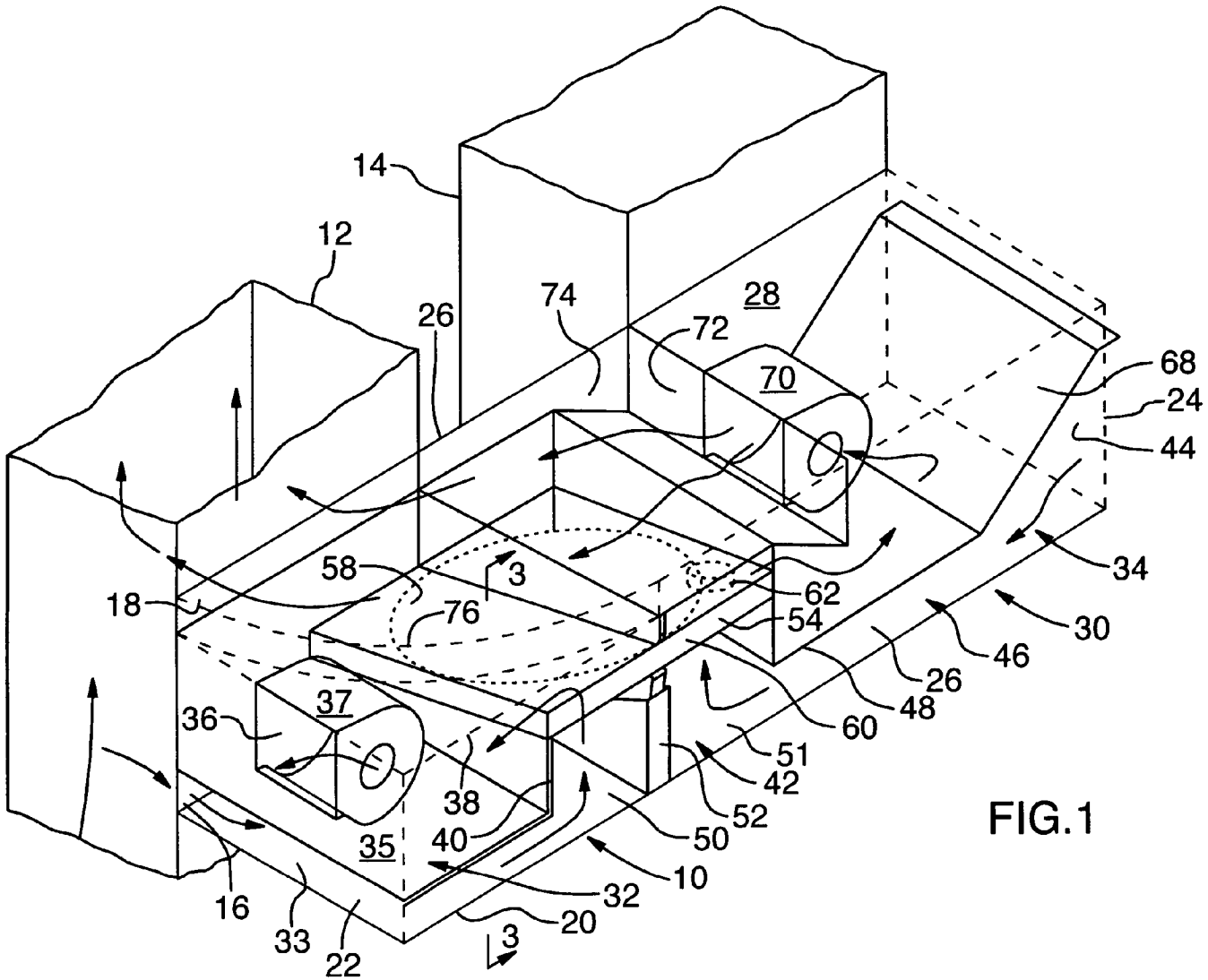
FIG. 1 is a perspective view of an energy recovery unit.
Figure 2:
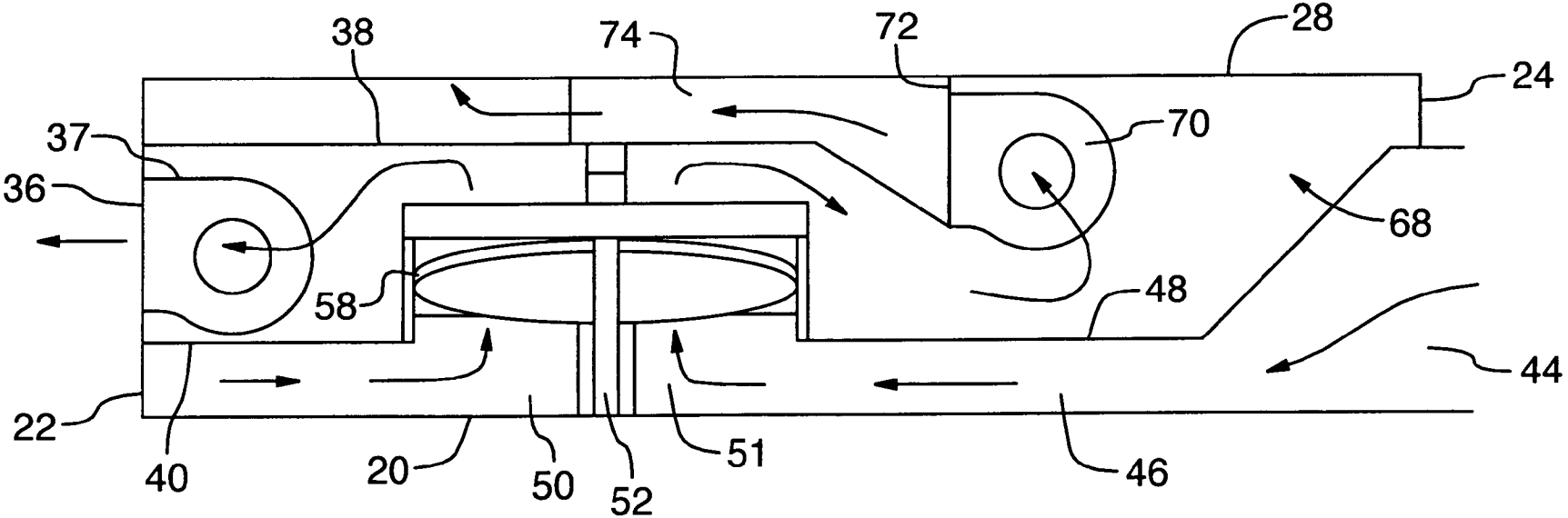
FIG. 2 is a front elevation of the energy recovery unit of FIG. 1.
Figure 3:
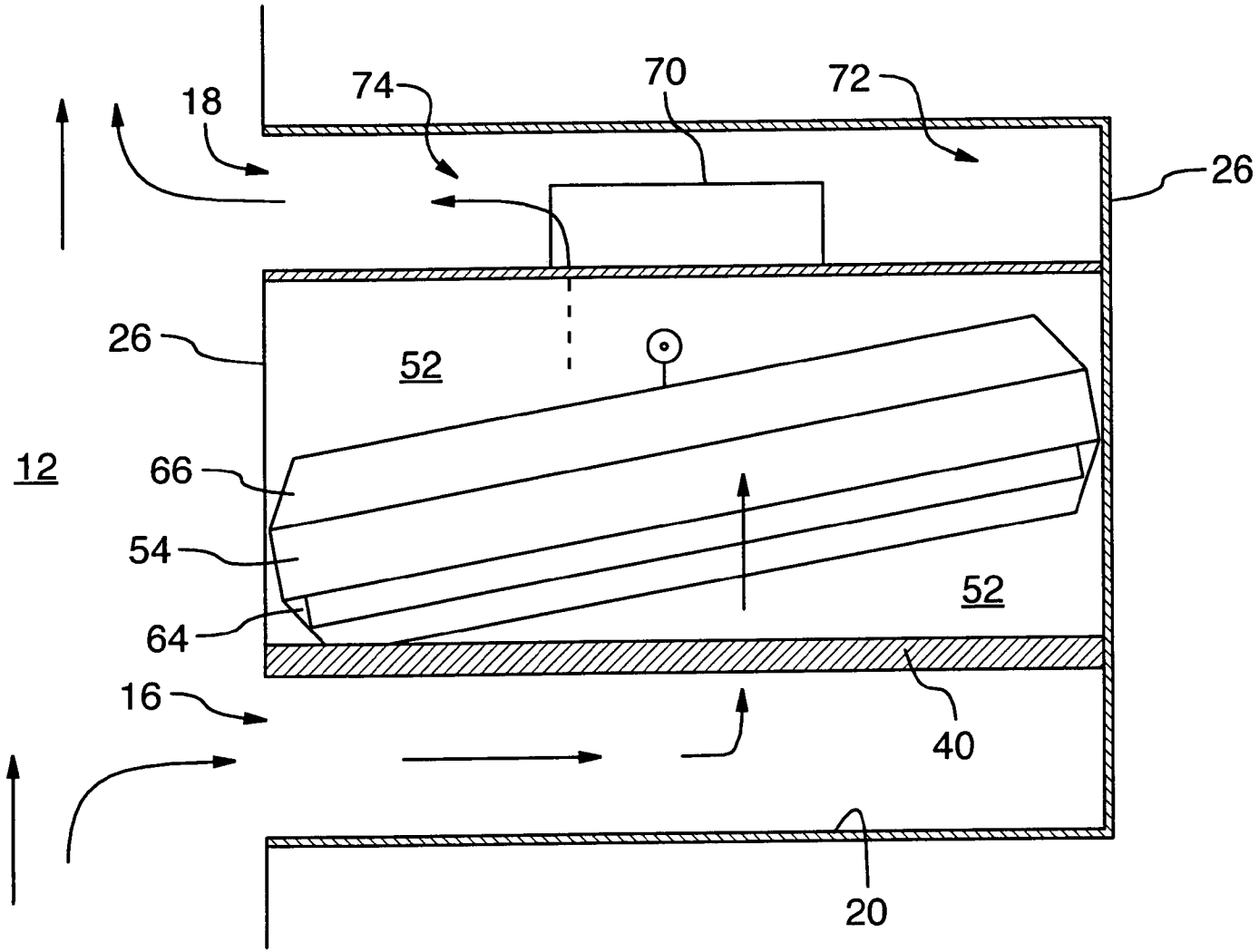
FIG. 3 is a view on the line III-III of FIG. 2.

Referring therefore to FIG. 1, an energy recovery unit 10 is located adjacent to a return duct 12 of an air circulation system. The air circulation system includes a supply duct 14 and the ducts 12, 14 are connected through an air handling unit (not shown) that heats or cools the air in the ducts 12, 14.

The energy recovery unit 10 has an inlet 16 and an outlet 18 that are connected at spaced locations to the return duct 12. As will be described more fully below, a portion of the air in the return duct 12 is diverted through the inlet 16 and a corresponding mass flow of makeup air supplied to the return duct 12 through the outlet 18.

The energy recovery unit 10 has a base 20 and oppositely directed end walls 22, 24. The end walls 22, 24 are connected by side walls 26 and a top wall 28 that collectively defines a housing 30 for the energy recovery unit 10. The housing 30 contains an expelled air duct 32 and a makeup air duct 34, each of which pass through a plenum 42. The expelled air duct 32 has an inlet portion 33 that extends from inlet 16 to the plenum 42. The inlet portion 33 of duct 32 is defined between the base 20 and an L-shaped panel 40 that defines one side of vertical plenum 42. The expelled air duct 32 has an exhaust chamber 35 that extends from the plenum 42 to an exhaust 36 provided in the end wall 22. The exhaust chamber 35 is defined between the panel 40 and a longitudinal partition 38 and a fan 37 is located in the chamber 35 to force air from the chamber 35 to the exhaust 36.

The makeup air duct extends from an intake 44 and has an inlet portion 46 defined between a longitudinal partition 48 and base 20. The inlet portion 46 terminates in the vertical plenum 42. The makeup duct 34 extends from the vertical plenum 42 into a chamber 68 defined between the upper side of the longitudinal partition 48 and the top wall 28. A fan 70 is mounted on a vertical wall 72 to deliver air from the chamber 68 to a discharge run 74 connected to the outlet 18. A smooth transition in the directional flow of the air is provided by a curved wall 76 extending between the top wall 28 and the upper side of the partition 38.

The vertical plenum 42 is subdivided into separate compartments 50, 51 by a central divider 52 that extends from the base 20 to the upper longitudinal partition 38. The divider 52 supports an energy recovery wheel assembly 54 that extends between the L-shaped panel 40 and a vertical panel 56 connecting the upper and lower longitudinal partitions 38, 48. The wheel assembly 54 is supported so as to be inclined relative to the base 20 and has a wheel 58 rotatably mounted in a support frame 60. The wheel 58 is driven by a motor 62 and rotates relatively slowly, typically 20 rpm, about its axis. The wheel 58 is porous and has an energy absorbing material. Such wheels are commercially available from American Energy Exchange of Kalamazoo Michigan. Seals 64, 66 seal between the wheel 58 and the divider 52 to inhibit the flow of air between the compartments 50, 51.

In use, some of the air in the return air duct 12 is diverted through the inlet 16 where it is delivered through the inlet portion 33 of expelled air duct to the compartment 50 of vertical plenum 42. The air passes through the wheel 58 which absorbs energy from the air and stores it within the wheel. The air flows into the chamber and is discharged through the exhaust 36 by the fan.

Similarly, fresh air is drawn into the makeup duct 34 through the intake 44 and delivered to the compartment 51 of the vertical plenum 42. The air flows through the wheel 58 which transfers energy to the air flow as it passes to the chamber 68. The fan 70 delivers air from the chamber 68 to the outlet 18 where it is mixed with the air in the return duct 12 for subsequent passage to the air handling unit.

The wheel 58 is continuously rotating and therefore passes through the divider 52 so as to transfer energy from the diverted air into the makeup air. In this way, energy may be recovered from the diverted air that is to be expelled.

It will be noted that the disposition of the wheel on an inclined plane relative to the base maintains a relatively low profile for the housing 30. Moreover, the serpentine arrangement of the passages within the housing 30 enables the inlet 16 and outlet 18 to be disposed adjacent one another in the duct 12 with the intake 44 and exhaust 36 located in opposite side walls to provide a compact overall design.

The embodiments of the invention in which an exclusive property or privilege is claimed are defined as follows:

1. An energy recovery unit comprising a plenum, an energy recovery wheel located within the plenum and passing through a divider that subdivides the plenum into a pair of compartments, an expelled air duct extending from an inlet through one of said compartments to an exhaust, a makeup air duct extending along a serpentine path from an intake through another of said compartments to a discharge, said intake and said exhaust being located on oppositely directed walls of said unit and said inlet and discharge being located on a common wall.

2. An energy recovery unit according to claim 1 wherein said makeup air duct includes an intermediate chamber between said intake and discharge and a fan is located in said intermediate chamber to force air to said discharge.

3. An energy recovery unit according to claim 2 wherein said chamber is located between said other compartment of said plenum and said discharge.

4. An energy recovery unit according to claim 1 wherein said expelled air duct includes an inlet portion and an exhaust chamber separated by said one compartment, said exhaust chamber and said inlet portion being juxtaposed and an exhaust fan is located in said exhaust chamber.

5. An energy recovery unit according to claim 4 wherein said discharge of said makeup duct is positioned on the opposite side of said exhaust chamber to said inlet portion.

6. An energy recovery unit according to claim 5 wherein said makeup duct includes an intermediate chamber between said intake and discharge and a fan is located in said intermediated chamber to force air to said discharge.

7. An energy recovery unit according to claim 6 wherein said makeup duct includes a curved wall between said fan and said discharge to turn the flow of air smoothly toward said discharge.

8. An energy recovery unit according to claim 1 wherein said energy recovery wheel rotates about a vertically oriented axis inclined to a base of said plenum.

9. An energy recovery unit according to claim 8 wherein said makeup duct traverses to divider to deliver make up air from said other compartment to said discharge.

10. An energy recovery unit according to claim 9 wherein said makeup duct includes an intermediate chamber between said intake and discharge and a fan is located in said chamber to force air to said discharge, said intermediate chamber being positioned on the same side of said divider as said other compartment.

* * * * *